United States Patent [19]

Butler et al.

[11] Patent Number: 4,958,396

[45] Date of Patent: Sep. 25, 1990

[54] GOLF CLUB AND GOLF BALL CLEANING DEVICE

[76] Inventors: Thomas L. Butler, 4321 Elmwood Dr., Fort Worth, Tex. 76116; Albert Stellar, 8501 Twilight Dr. West, Fort Worth, Tex. 76116

[21] Appl. No.: 371,626

[22] Filed: Jun. 26, 1989

[51] Int. Cl.[5] ..... A63B 57/00; A63B 47/04; A46B 13/08

[52] U.S. Cl. ..... 15/21.2; 15/88.4

[58] Field of Search ..... 15/21 R, 21 A, 21 B, 15/21 C, 21 D, 21 E

[56] References Cited

U.S. PATENT DOCUMENTS 3,268,934 8/1966 Postula et al. ..... 15/21 R X
3,304,659 2/1967 Eichhorn ..... 15/21 A
3,748,676 7/1973 Warren et al. ..... 15/21 A
3,950,810 4/1976 Harkess ..... 15/21 C
4,872,232 10/1989 Stiasny ..... 15/21 R X

*Primary Examiner*—Edward L. Roberts

[57] ABSTRACT

A golf ball and golf club cleaning device uniquely suited to the task of cleaning golf balls and golf clubs with wood or metal heads of either left-handed or right-handed configuration. This device employs a rotating segment brush assembly, lifted by cam action, to work about its x and y axes simultaneously; and further, this device provides a spring-biased club head receiver, assuring positive club head placement and brush contact. A ball carrier slide extending vertically from the housing lid provides proper ball insertion, cleaning and removal. Additionally, size and configuration of this device are compatible to either stationary mounting, or mounting to a motorized vehicle for transporting players about a golf course.

1 Claim, 2 Drawing Sheets

GOLF CLUB AND GOLF BALL CLEANING DEVICE

FIELD OF INVENTION

This invention relates to a cleaning device, and more particularly to a golf club and golf ball cleaning device suitable for stationary use or as an accessory item to a vehicle used in the transport of players about a golf course.

BACKGROUND OF INVENTION

In the game of golf the accumulation of dirt and debris on the head and face of a golf club and on the surface of a golf ball tend to adversely affect a player's game by altering club weight, clogging grooves in the face of a club head, and by presenting an untrue surface when striking a ball. This all leads to frustration and lessened enjoyment expected from the game of golf.

This invention alleviates these distresses and remedies shortcomings of prior known golf club cleaning devices by presenting the club head firmly and positively to the cleaning actions of a segmented wheel brush working in two directions simultaneously. The golf ball cleaning capability of this device provides a utilitarian feature not found in other cleaning equipment, making this invention more economically feasible to those who use such equipment.

Prior golf art such as shown in U.S. Pat. No. 3,950,810 (HARNESS) offers brushing action in only one direction and brush action is further limited by the semi-spherical brush configuration.

U.S. Pat. No. 4,380,839 (CARDONA) is suited only to the cleaning of golf clubs known as "irons," and by nature of its design does not provide cleaning action paralleling grooving on a club head.

Golf club washing machine, U.S. Pat. No. 3,332,099 (REHTER), requires a source of electrical power and is of such size and bulk as to render it unsuited for mobility and placement at convenient locations through the length of a golf course.

None of the above cited Patents features a capability for cleaning golf balls as well as golf clubs.

SUMMARY OF INVENTION

It is the intention of the inventor to disclose a utilitarian golf equipment cleaning device of improved design, compatible to and capable of the following:

1. Cleaning both right-handed and left-handed golf clubs
2. Cleaning irons
3. Cleaning woods
4. Providing cleaning action parallel to club grooving
5. Providing positive placement of clubs during cleaning
6. Cleaning of golf balls
7. Stanchion-mounting at a club house and at convenient locations throughout the length of a golf course
8. Mounting as an accessory to a powered vehicle used to transport players about a golf course Yet another specific intention is to provide a device capable of applying two directional cleaning actions to club heads.

The cleaning device of this invention is composed of a rectangular box housing material, and having its longitudinal plane horizontal to the ground. Its side and end walls rise vertically from the bottom surface, all containing a cleaning liquid within.

A hand crank supplying power to the brush wheel, located within the housing, extends diagonally downward through a boss located on the bottom edge of the front wall of the housing.

A lid comprised of two sections is positioned atop the housing. The front lid section, ridigly secured to the housing, provides an aperture through which a ball-carrier-slide extends vertically to receive and channel a golf ball for cleaning within. The rear lid, hinged to the rear wall of the housing, lifts open to retract a sliding club head pressure-plate and exposes an unobstructed, spring-biased club head receiver into which a club head is placed while its shaft extends vertically. Two indentations, marked left and right respectively, in the front edge of the rear lid section pass around and grip the club shaft as the lid closes, supporting the shaft while the head is cleaned by a rotating segmented brush.

BRIEF DESCRIPTION OF DRAWINGS

With the above considerations and objectives in mind, the device will now be described in connection with the preferred embodiment, given by example and not limitation, with reference to the accompanying drawing.

DESCRIPTION OF EMBODIMENT

Figure 1:
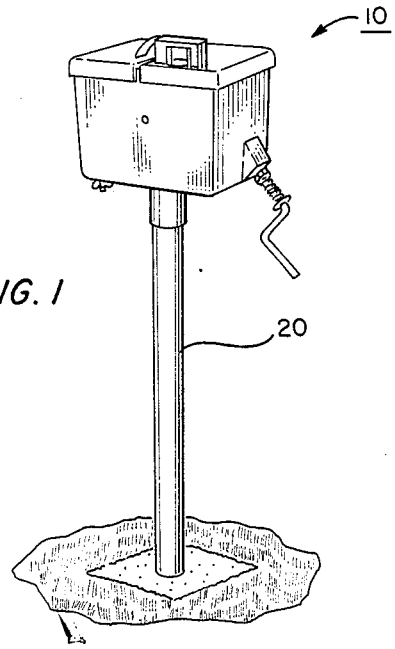
FIG. 1. Perspective view of golf club and golf ball cleaning device.
Figure 2:
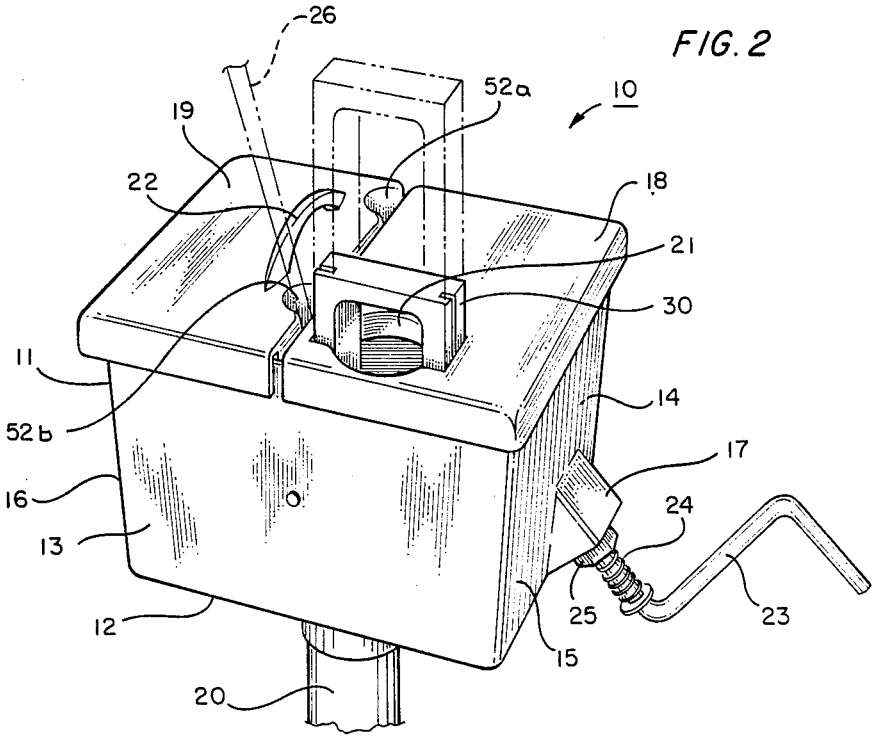
FIG. 2. Perspective view showing external features.

Referring now to the drawings, the numeral 10 indicates generally the golf club and golf ball cleaning device of this invention. As shown in FIGS. 1 and 2, the device (10) resembles a box mounted atop a stanchion (20), implanted vertically in the ground.

(Designations as to orientation of the device described are given with the assumption the device is being viewed from the end from which the crank handle extends. That end is designated front, and all other designations, i.e., left, right, top, bottom, and back, are from that perspective.)

Referring to FIGS. 1–2, the device (10) discloses a rectangular box housing (11), constructed of cast metal, molded fiberglass, or other suitable plastic material and consists of bottom (12), left side wall (13), right side wall (14), front wall (15), and rear wall (16), all extending vertically from bottom (12), and together containing a cleaning liquid within.

A crank boss (17) projects from front wall (15) at its juncture with bottom (12). The front lid section (18) is secured to top margins of side walls (13 and 14), and front wall (15). Aperture (21) provides for movement of ball-carrier-slide (30) which extends vertically from within housing (11).

Figure 3:
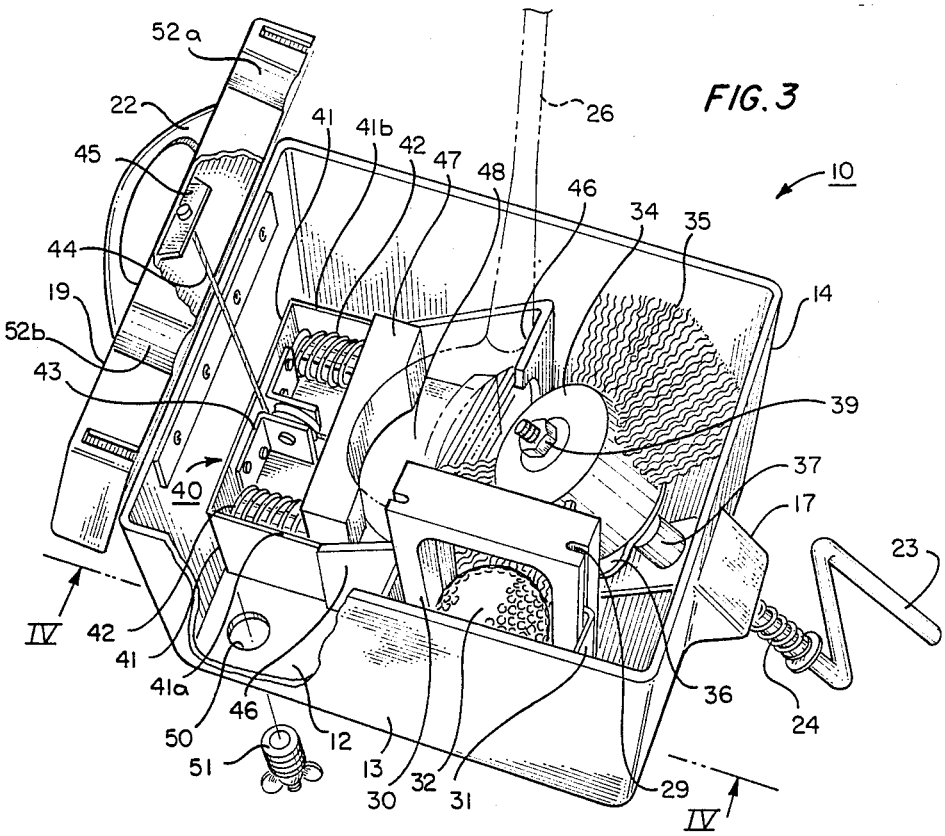
FIG. 3. Perspective cut-away showing internal features.

Refer to FIG. 3. Rear lid section (19), hinged to top margin of rear wall (16), opens upwardly, acting on club head receiver assembly (40) by compressing springs (42) and retracting club head pressure plate (47) to create an unobstructed cavity to receive a club head (26).

FIG. 3 discloses relative location of club head receiver assembly (40), brush wheel assembly (33) and brush mounting bracket (38) within housing (11). Number 26 indicates club placement.

Brush assembly (33) consists of a plastic hub (34) with an integral cam (36) projecting from the bottom side thereof. Bristle bundles (35), of nylon or other similar material, extend radially from hub (34), terminating in a circular plane. Bristle bundles (35) are placed in opposing 90-degree segments of hub (34) to provide alternating bristled and non-bristled areas. Brush assembly (33) secures to threaded portion of crank rod (23) by hex nuts (39).

Figure 4:
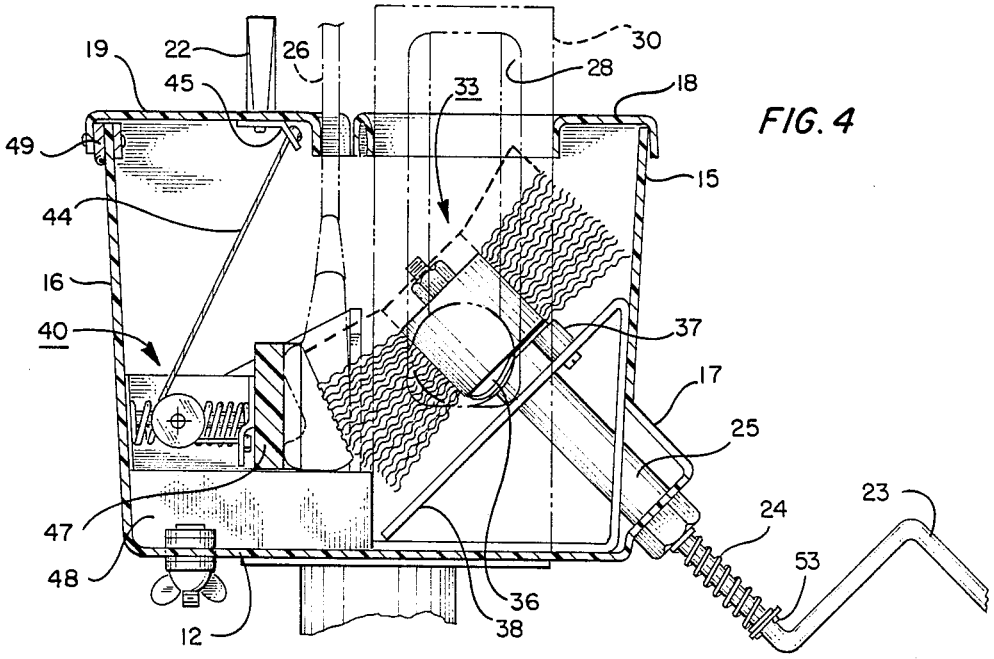
FIG. 4. Side sectional view taken at Line IV—IV of FIG. 3.

Refer now to FIGS. 3 and 4, brush mounting bracket (38), formed of sheet metal, situates diagonally at 45 degrees to housing front wall (15) and housing bottom (12), with its center line slightly right of center of housing (11). Steel crank bushing (25), having a threaded end portion and a hexagonal head, enters housing (11) through boss (17) and passes diagonally upward at 45 degrees through front wall (15) and continues through an aperture (not shown) in brush mounting bracket (38) to form a perpendicular junction therewith Hexagonal nut (not shown) secures bushing (25) and bracket (38) within housing (11). Steel crank rod (23) passes through the bore of bushing (25), securing to brush assembly (33) by hex nuts (39). Retention spring (24) surrounding crank rod (23) between boss (34) and pin (53) maintains brush assembly (33) in retraction against cam lifter (36). Cam lifter (36), fabricated of high density plastic material, affixes by rivet to mounting bracket (42), within the perimeter described by the circumference of brush hub (34), so as to provide lifting motion to brush assembly (32) when contacted by cammed segment (36) of brush hub (34), thus producing two-dimensional brush action.

FIG. 3 depicts club head receiver assembly, referred to generally as 40, consisting of club head receiver tray (41), constructed of sheet metal, with its rear wall (41*c*) and side walls (41*a* and 41*b*) folded 90 degrees to its bottom surface, thereby presenting the appearance of a three-sided container. Club head stops (46), formed of durable plastic material, affix by rivets or other suitable fasteners to front ends of side walls (41*a* and 41*b*) of club head receiver tray (41).

Club head pressure plate (47) and club head pressure plate track (48), both machined from high density plastic, join together with pressure plate (47) mounted astride track (48). Inwardly disposed gibs of pressure plate (47) mate with longitudinally grooved edges of track (48), giving guidance and stability to pressure plate (47) during retraction and extension. Together track (48) and pressure plate secure within the cavity of club head receiver tray (41) by a bolt, passing downwardly through track (48) and in turn, through tray (41) and bottom (12) of housing (11). Compression springs (42) position horizontally between pressure plate (47) and vertical rear wall (41*c*) of bracket (41), extend pressure plate forward and secure a club head (26) against club head stops (46). Cable (44) attached at center of pressure plate (47), passes through pulley assembly (43) and terminates by attachment at front edge of hinged rear lid section (19) and cable attaching bracket (45).

Pull applied to handle (22), transmitted through cable (44), compresses springs (42), retracts pressure slide (47) and creates within club head receiver assembly (40) an unobstructed cavity to receive a golf club head for cleaning by brush assembly (33). Released energy of springs (42) extends pressure plate (47), securing a club head against stops (46) when lid (19) closes.

Indentations (52) in front edge of lid (19) surround club shaft (26) to assure further stability during cleaning.

Referring to FIGS. 3 and 4, the ball washer assembly consists of ball carrier (30) and ball carrier track (31). Ball carrier track (31), formed of sheetmetal and having inwardly directed flanged edges, is positioned vertically and secured within housing (11) by appropriate fastening means. Ball carrier (30), machined from high density plastic, mates with ball carrier track (31) by meshing of grooved slide edges (29) with inwardly directed flanges of slide track (31). Ball carrier passes vertically through aperture (21) in lid (18). Ball slot (28) in ball carrier (30) allows ball (32) insertion at a point above top surface of lid (18) and channels ball (32) to position for cleaning by brush (33). Transverse tapering of ball slot (28) limits transverse ball travel.

Diagonal disposition of brush assembly (33) and vertical disposition of ball carrier slide (30) positions a golf ball so as to be lifted and rotated as ball-brush contact occurs, thereby presenting an increased ball surface area with each ball-brush contact. As non-bristled segments rotate to the normal location of ball-brush contact, gravity retracts the ball to the lowest position within the ball slot (28), a ball-brush contact recurs with the alternate bristled brush segment, and cleaning action is repeated.

Drainage for fluid contained within housing is provided by drain hole (50) and drain plug (51).

This invention should not be considered limited to the details tending to modifications obvious to one skilled in the art.

We claim:

1. A cleaning device for golf clubs and golf balls comprising:

a housing having an open top and first and second lid sections, said first lid section hinged to an edge of said housing opening and covering a first portion of the open top, and said second lid section fixed to said housing and covering a second portion of the open top, said first lid section having opening means to receive a golf club handle when said first lid section is closed, said second lid section having an opening for receiving a golf ball carrier means having a golf ball carried thereby; a brush means rotatably mounted in said housing adjacent to the bottom portion thereof, and means to rotate and induce simultaneous reciprocating movement of said brush means along the longitudinal axis of said means of rotation;

golf club support means mounted in said bottom portion under said first lid section and including means for biasing a golf club toward said brush means; means connecting said first lid section to said biasing means to move said biasing means away from said brush when said first lid section is pivoted open and to permit the biasing means to move toward the brush means when the lid is closed whereby when said first lid section is open a golf club is positioned on said support means and upon closing said lid the biasing means moves said golf club into the path of said rotating brush means to clean said golf club; and a ball carrier means mounted in the opening of said second lid section and positioned to move a golf ball into the path of said rotary brush means to clean said golf ball.

* * * * *